US005682957A

United States Patent [19]

Lyon

[11] Patent Number: 5,682,957

[45] Date of Patent: Nov. 4, 1997

[54] WATER SEPARATOR FOR A DOWN HOLE DRILL

[75] Inventor: Leland H. Lyon, Roanoke, Va.

[73] Assignee: Ingersoll-Rand Company, Woodcliff Lake, N.J.

[21] Appl. No.: 576,029

[22] Filed: Dec. 21, 1995

[51] Int. Cl.[6] ..... E21B 1/06

[52] U.S. Cl. ..... 175/100; 175/231; 175/296

[58] Field of Search ..... 175/100, 296, 175/231, 69

[56] References Cited

U.S. PATENT DOCUMENTS

| | | | |
|---|---|---|---|
| 3,941,196 | 3/1976 | Curington et al. | 175/100 |
| 5,139,095 | 8/1992 | Lyon et al. | 175/100 X |
| 5,240,083 | 8/1993 | Lyon | 175/340 X |

*Primary Examiner*—William P. Neuder
*Attorney, Agent, or Firm*—John J. Selko

[57] ABSTRACT

A device for use within the backhead of a down hole percussive drill, for removing debris from a drillhole, includes a flow control member in the drill backhead for inducing cyclonic flow of percussive fluid, to concentrate the heavier water and other matter away from the lighter percussive gases, a separator in the backhead that separates the water and other matter, passageways in the backhead for ejecting the separated water and other matter, a sealing member for sealing the backhead passageways against back flow of debris from the drillhole annulus, and an indexing member for positioning the separator so as to permit a pre-selection of flow amounts of removed water and other matter.

8 Claims, 4 Drawing Sheets

WATER SEPARATOR FOR A DOWN HOLE DRILL

BACKGROUND OF THE INVENTION

This invention relates generally to rock drills and more particularly to pneumatically operated percussive drills of the type adapted to be inserted into the drillhole being drilled. Such a drill in commonly known as a down hole drill.

Many applications for down hole drills require that liquids, such as water and other matter be injected into the drill air for hole cleaning. Prior art separating devices remove this water and other matter and eject it through, or near, the drill bit. Water ejected in the vicinity of the drill bit makes for wet working conditions, retarding the removal of debris and slowing the rate of drill penetration.

The foregoing illustrates limitations known to exist in present down hole drill water removal devices. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a down hole drill that is actuated by a mixture of percussive fluid and water comprising: a backhead assembly for attachment to a drill string; a hammer assembly for attachment to the backhead assembly; and means in the backhead assembly for separating at least a portion of the water from the fluid and water mixture and for ejecting the separated portion of water from the backhead assembly before the fluid, minus the removed water, is transmitted into the hammer assembly.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
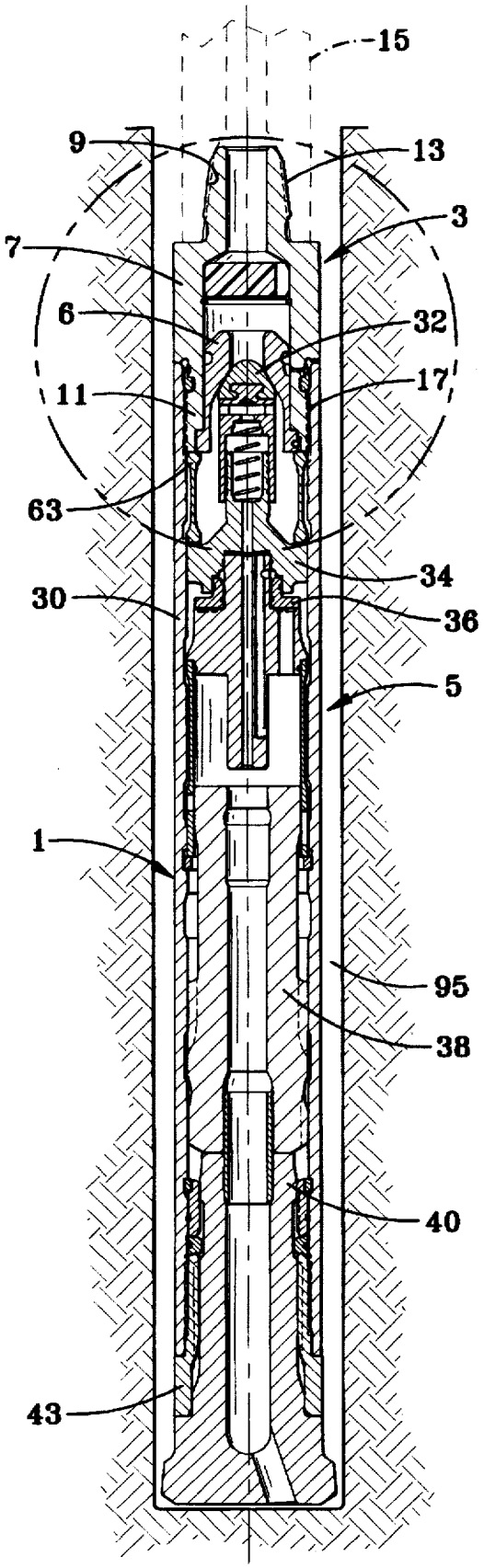
FIG. 1 is a schematic elevational view, in cross section, with parts removed, of a down hole drill having the invention therein.

FIG. 1 shows a down hole drill 1 that is actuated by a mixture of percussive fluid and other matter. As used herein the terms "percussive fluid" or "fluid" mean compressed air, but other compressed gases, or mixtures of gasses, known to those skilled in the art can work. The other matter can be water for flushing out the drill hole annulus, oil for lubrication, soap and foam for hole cleaning and rust particles from the drill string. As used herein the term "water" means water, but other liquids, or mixtures of liquids, known to those skilled in the art can work.

Drill 1 includes as major subassemblies a backhead assembly shown generally as 3, a hammer assembly shown generally as 5, and the separator of this invention shown generally as 6. Separator 6 is positioned in backhead assembly 3 for separating at least a portion of the water from the fluid and water mixture and for ejecting the separated portion of water from backhead assembly 3 before the fluid, minus the removed water, is transmitted into hammer assembly 5, as described hereinafter.

Figure 2:
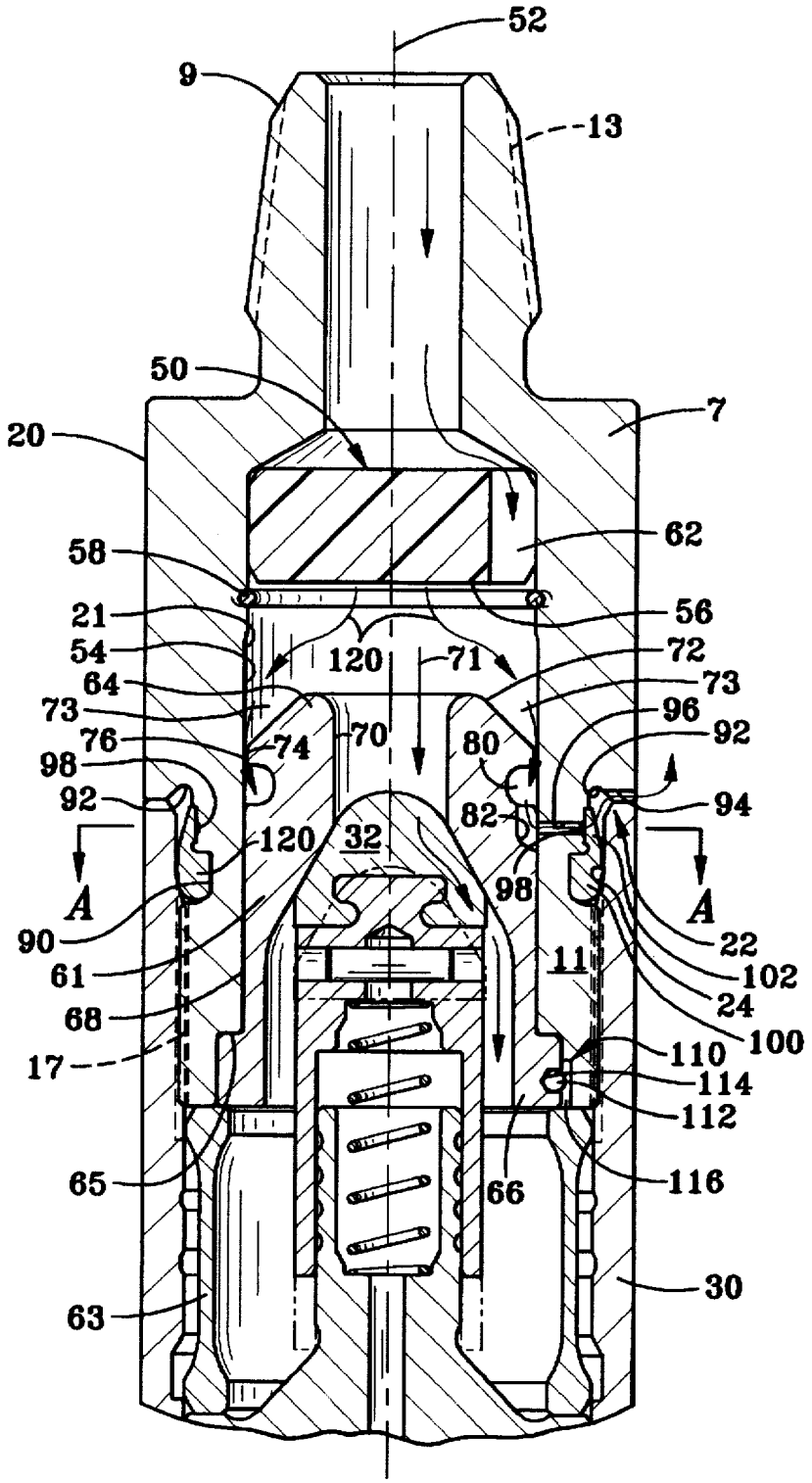
FIG. 2 is an enlarged view, with parts removed, of the invention in the encircled portion of FIG. 1.

As shown in FIGS. 1 and 2, backhead assembly 3 includes a hollow, tubular body 7 having a drill string end 9 and a hammer assembly end 11. First thread means 13 threadably connects drill string end 9 to a drill string 15, as is well known. Second thread means 17 threadably connects hammer assembly end 11 to hammer assembly 5, as is will known. Sidewall portion 20 extends between drill string end 9 and hammer assembly end 11, and forms a bore 21 therethrough. Backhead passageway means, shown generally as 22, transmits water removed from the fluid/water mixture as described hereinafter. Movable seal means 24 closes passageway means 22, when percussive fluid is not flowing and opens passageway means 22, when percussive fluid is flowing, as described hereinafter.

Hammer assembly 5 can be of any conventional down hole drill hammer assembly, as hammer assembly 5 is not part of this invention. By way of illustration, hammer assembly 5 will include a casing 30 threadably connected to backhead body 7, as is well known. Positioned within casing 30 is a normally closed conventional check valve 32 to prevent back-flow of fluid and other debris from the hole annulus, when the drill is inoperative. In FIG. 2, check valve 32 is shown in the closed position, and in the open position in phantom. A fluid distributor 34 (FIG. 1) directs percussive fluid to a pressure sensitive valve 36. Valve 36, opens and closes to reciprocate piston 38 to impact a drill bit 40 positioned in chuck 42 as is well known. I prefer a hammer assembly such as described in U.S. Pat. No. 5,301,761 to C. C. FU, but other conventional hammer assemblies will work.

Referring to FIGS. 2–6, the separator 6 of this invention will be further described. Separator 6 includes an inducing means 50 for causing cyclonic, vortex flow of the mixture of fluid and water in bore 21, around an axial centerline 52 extending through backhead body 7. The cyclonic flow concentrates a portion of the water to be removed from the percussive fluid at a position in backhead body 7 that is away from axial centerline 52, and adjacent to inner surface 54 that forms bore 21. Inducing means 50 is a propeller-like flow control member 56 fixedly positioned in bore 21 adjacent drill string end 9. Flow control member 56 is nonrotatable, and may be held in place by a friction-fit or by retaining annular ring member 58. Flow member 56 includes a plurality of blades 60 spaced apart from each other to form a plurality of fluid flow passageways 62 spiralling axially in a direction from drill string end 9 toward hammer assembly end 11. Percussive fluids, liquids and other matter which pass through inducer 50 develop a cyclonic flow pattern whereby the heavier fraction of material, generally the liquids and other solid matter, migrate radially outward to the backhead bore 21. This migration creates a concentration of lighter fraction material, generally air and vapor, within the center of bore 21. The lighter fraction gasses then pass through the bore 70 of separator 6 and into the operating chambers of the hammer assembly 5, as shown by arrow 71.

Separator 6 further includes a separating means formed by a hollow, tubular separator body 61 having a drill string end 64 and a hammer assembly end 66, with a sidewall portion 68 extending therebetween. Body 61 is made from an engineering plastic material, as described hereinafter. Sidewall portion 68 forms a separator bore 70 extending axially through separator body 61. Bore 70 is concentric with axial centerline 52 of backhead bore 21. Bore 70 serves as the seating port for check valve 32. Separator body 61 is fixedly and nonrotatably positioned in backhead bore 21, adjacent to flow control member 56. Body 61 is trapped between a spacer 63 that contacts distributor 34 and a shoulder 65 on end 11 of body 7. Spacer 63 is held in place, when backhead assembly 3 is threadably connected to casing 30. The trapping of body 61 bulges body 62, and causes body 61 to assume a fluid-tight contact with inner surface 54 of body 7. Alternatively, a separate elastomeric O-ring seal member (not shown) can be interposed between body 62 and surface 54.

Drill string end 64 forms a flow surface 72 sloped axially toward backhead sidewall 20. Flow surface 72 is oriented such that it is closer to bore centerline 52 at drill string end 64 than at end 66. Thus, it can be understood that surface 72 forms a gallery 73 around its outer diameter for heavier fluid and matter to be collected. Flow surface 72 terminates in an annular land 74 spaced from surface 54 of sidewall 20, to form a passageway 76 between backhead sidewall 20 and land 74. Passageway 76 prevents large debris from clogging passageways 22.

Figure 3A:
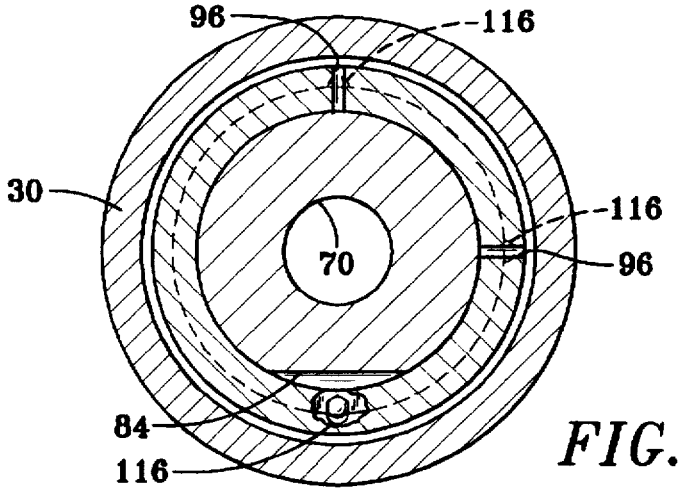
FIG. 3A is a cross section along A—A of FIG. 2, with the separator of this invention indexed in a first position.
Figure 3B:
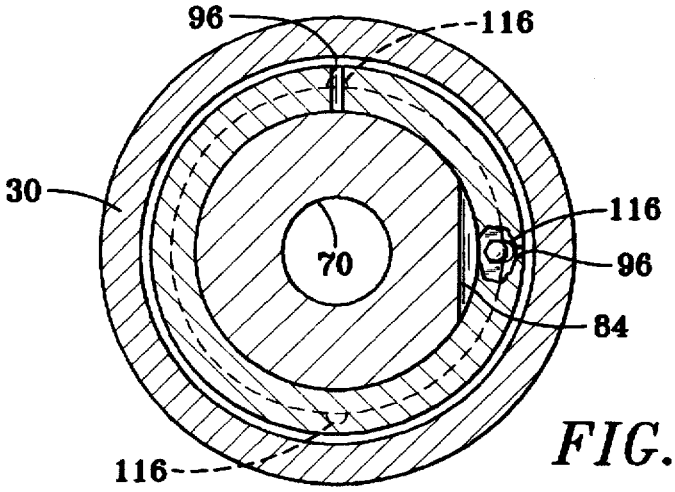
FIG. 3B is a cross section along A—A of FIG. 2, with the separator of this invention indexed in a second position.
Figure 3C:
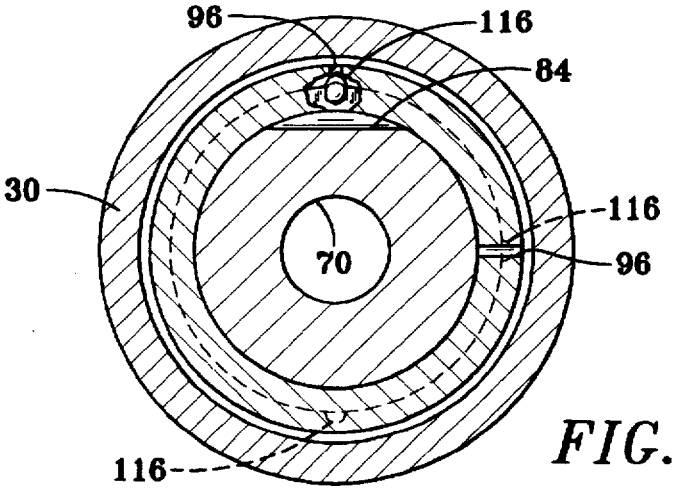
FIG. 3C is a cross section along A—A of FIG. 2, with the separator of this invention indexed in a third position.
Figure 4:
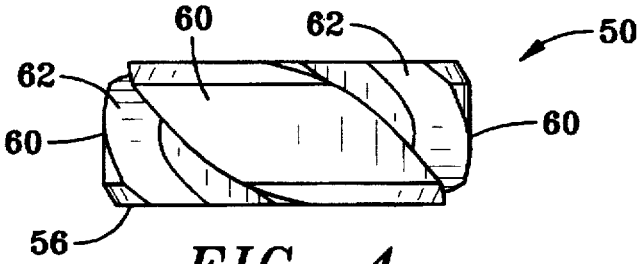
FIG. 4 is a side elevational view of the flow control member of this invention.
Figure 5:
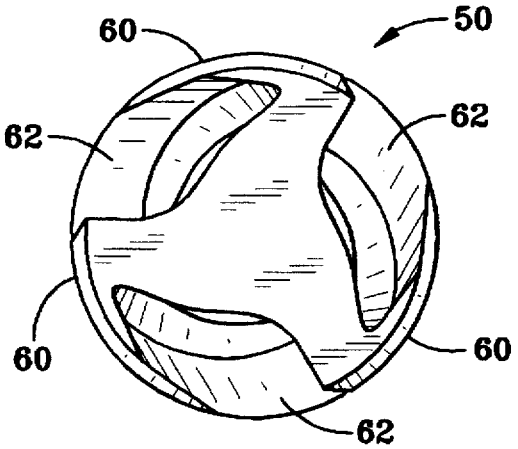
FIG. 5 is a top view of the flow control member of this invention.
Figure 6:
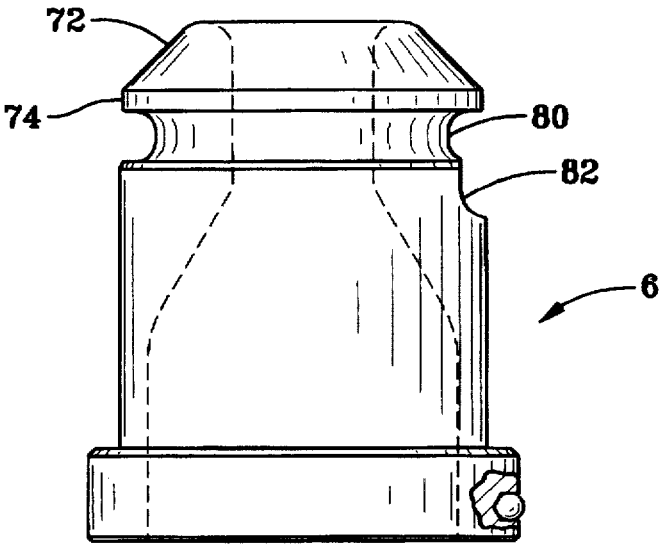
FIG. 6 is a side elevational, partial cross sectional view of the separator of this invention.

Separator 6 includes annular passageway gallery 80 in separator sidewall 68, for connecting with backhead sidewall passageways 22. Annular passageway gallery 80 connects to a further undercut portion 82 of sidewall 68. As seen in FIGS. 3A–C, undercut portion 82, is not annular, but forms a chord line 84.

Referring to FIG. 2, the backhead passageways 22 will be further described. Backhead sidewall 20 includes a first annular undercut portion 90 adjacent thread means 17. Undercut portion forms a seat for a seal means 24, as described hereinafter. Undercut portion 90 includes a second annular undercut portion 92 forming a collection gallery that opens to bevel groove 94, thereby opening sidewall 20 to drillhole annulus 95. Backhead passageways 22 further include at least one bypass orifice 96 through sidewall 20. I prefer two orifices spaced circumferentially apart from each other, with each orifice having a different cross-sectional dimension, i.e. diameter. Each orifice 96 connects to an annular fluid flow groove, 98, which opens into undercut portion 92.

Seal means 24 is an elastomeric O-ring member 100 having a diameter slightly smaller than the diameter of threaded hammer assembly end 11, so that member 100 requires stretching for installation, and it will thereafter contract into sealing position in undercut portion 90. Member 100 has a flexible flap portion 102 that seals orifice 96 and flow groove 98, when percussive fluid is not flowing. Seal 100 also prevents back flow of debris from hole annulus 95 into hammer assembly 5, when percussive fluid is not flowing. During the flow of percussive fluid, flap 102 moves out of sealing contact, permitting the ejection of water from backhead body 7. The pressure difference that exists between annular passageway gallery 80 and drillhole annulus 95 accelerates heavier material through orifice 96.

Separator 6 is slip fit into body 7, and pinned from radial rotation by indexing means 110. I prefer indexing means 110 to include a spherical ball bearing member 112 force-fit into a cavity 114 in separator sidewall 68, so that at least a portion of member 112 extends out of cavity 114 to slidably fit into one of a plurality of axially extending indexing grooves 116, machined into sidewall 20 of backhead body 7. In assembly, the separator 6 is indexed over a groove 116 and slip fit into body 7. By positioning undercut 82 adjacent to different sized orifices (FIGS. 3B and C) the amount of flow from backhead 7 can be preselected. To change the flow, one merely re-indexes the separator. By positioning undercut 82 adjacent to a portion of sidewall 20 that has no orifice therein, flow can be entirely stopped (FIG. 3A). Arrow 120 of FIG. 2 indicate flow of separated water and other matter out of backhead 7.

I prefer to provide flow control member 56 and separator body 62 from an engineering plastic material specified by the trademark DELRIN supplied by E. I. DuPont DeNemous Company. I prefer to provide seal member 100 from an elastomeric material specified as elastomeric rubber nitrile, Shore hardness 70-A, supplied by Rubber and Silicone Company, Caldwell, N.J.

Having described the invention, what is claimed is:

1. In a down hole drill that is actuated by a mixture of percussive fluid and water, a water separator comprising:

(a) backhead means for attachment to a drill string at a first end and to a hammer assembly at a second end;

(b) inducing means for causing cyclonic, vortex flow of said mixture of fluid and water around an axial centerline extending through said backhead means, said cyclonic flow concentrating a portion of said water to be removed from said percussive fluid at a position in said backhead means that is away from said axial centerline;

(c) separating means for separating said portion of water to be removed from said percussive fluid and for ejecting said portion of water from said backhead means before said portion of water can enter said hammer assembly, said separating means simultaneously transmitting said fluid, minus said portion of removed water, into said hammer assembly;

said backhead means further comprising;

(d) a hollow, tubular body having a drill string end and a hammer assembly end, with a sidewall portion extending therebetween;

(e) said backhead sidewall forming a backhead bore extending axially along a centerline through said body;

(f) first thread means for threadably connecting said drill string end to a drill string;

(g) second thread means for threadably connecting said hammer assembly end to a hammer assembly;

(h) backhead passageway means in said backhead sidewall for transmitting said water removed from said fluid out of said backhead bore; and (i) movable seal means for closing said backhead sidewall passageway means, when said percussive fluid is not flowing, and for opening said backhead sidewall passageway means, when said percussive fluid is flowing.

2. The water separator of claim 1 wherein said inducing means comprises:

(a) a propeller-like flow control member fixedly positioned in said backhead bore, adjacent said backhead drill string end, said flow control member having a plurality of blades thereon forming a plurality of fluid flow passageways spiraling axially in a direction from said drill string end toward said hammer assembly end.

3. The water separator of claim 2 wherein said separating means comprises:

(a) hollow, tubular separator body having a drill string end and a hammer assembly end, with a sidewall portion extending therebetween;

(b) said separator sidewall portion forming a separator bore extending axially through said separator body, said separator bore concentric with said axial centerline of said backhead bore;

(c) said separator body being fixedly positioned in said backhead bore, adjacent to said flow control member;

(d) said separator drill string end forming a flow surface sloped axially toward said backhead sidewall, said flow surface being closer to said bore centerline at its drill string end, said flow surface terminating in an annular land spaced from said backhead sidewall to form a passageway between said backhead sidewall and said land; and (e) separator passageway means in said separator sidewall for connecting with said backhead sidewall passageway means, whereby said removed water can be transmitted out of said backhead, when said percussive fluid is flowing.

4. The separator of claim 3 further comprising:

(a) said backhead passageway means including said backhead sidewall having a first annular undercut portion, adjacent said second thread means, forming a seal groove for seating said seal means, said first undercut portion including a second annular undercut portion forming a collection gallery for removed water;

(b) at least one orifice through said backhead sidewall;

(c) said orifice connected to an annular fluid flow groove, extending circumferentially in said first undercut portion; and (d) said seal means seated in said seal groove and having a flexible end portion extending in sealing contact with said orifice and said flow groove, whereby said flexible member is moved out of sealing contact with said orifices and said flow groove by said removed water, when said percussive fluid is flowing.

5. The separator of claim 4 further including means for adjusting said separating means to vary the amount of water ejected from said backhead means.

6. The separator of claim 5 wherein said means for adjusting said separating means comprises:

(a) a plurality of orifices through said backhead sidewall, said orifices being circumferentially spaced apart from each other, each said orifice being of a different cross-sectional size; and (b) means for positioning said separator body in said backhead bore in a plurality of positions, each position placing said separator passageway means in fluid connection with a different sized orifice through said backhead sidewall, whereby a different amount of water can flow therethrough to be ejected from said backhead means at each said position.

7. The separator of claim 6 wherein said means for positioning said separator body in said backhead bore in a plurality of positions comprises:

(a) a plurality of grooves extending axially along said backhead sidewall, said grooves being open into said backhead bore and extending to said hammer assembly end of said backhead body;

(b) said grooves being circumferentially spaced apart from each other around said backhead body;

(c) indexing means on said separator body for slidably fitting into at least one of said grooves, to lock said separator body into a preselected circumferential position, whereby said separator passageway means connects with a preselected orifice through said backhead sidewall, whereby a preselected amount of water can flow therethrough to be ejected from said backhead means.

8. The separator of claim 7 wherein said indexing means comprises a spherical ball bearing member force-fit into a cavity in said separator sidewall, said ball bearing member having a portion thereof extending out of said cavity to slidably fit into at least one of said grooves.

* * * * *